United States Patent [19]

Mackie

[11] 4,105,166

[45] Aug. 8, 1978

[54] TEXTILE YARN OR TAPE WINDING MACHINES

[75] Inventor: Gordon Mackie, Belfast, Northern Ireland

[73] Assignee: James Mackie & Sons Limited, Belfast, Northern Ireland

[21] Appl. No.: 679,603

[22] Filed: Apr. 23, 1976

[30] Foreign Application Priority Data

Apr. 28, 1975 [GB] United Kingdom ..... 17590/75

[51] Int. Cl.[2] ..... B65H 59/38

[52] U.S. Cl. ..... 242/45; 242/18 CS; 242/67.5

[58] Field of Search ..... 242/18 CS, 45, 67.5, 242/75.5, 75.51; 57/91, 93

[56] References Cited

U.S. PATENT DOCUMENTS

| | | | |
|---|---|---|---|
| 557,620 | 4/1896 | Sisum | 242/18 CS |
| 2,545,534 | 3/1951 | Truitt | 242/18 CS |
| 2,978,195 | 4/1961 | Weber et al. | 242/45 |
| 3,047,247 | 7/1962 | Kotte | 242/45 |
| 3,180,584 | 4/1965 | Blunck et al. | 242/45 |
| 3,221,518 | 12/1965 | Bassist | 242/45 X |
| 3,891,155 | 6/1975 | Naegeli | 242/45 |

*Primary Examiner*—Richard C. Queisser
*Assistant Examiner*—Charles Gorenstein
*Attorney, Agent, or Firm*—Pollock, Vande Sande & Priddy

[57] ABSTRACT

A method of maintaining the peripheral speed of a textile yarn or tape package being wound on a positively driven take-up spindle at or about a predetermined speed comprising sensing the peripheral speed of the package, comparing this speed with the predetermined speed and varying the drive to the take-up spindle in accordance with variations between the actual and set or predetermined speeds of the package until the peripheral speed of the package is substantially equal to the set or predetermined speed.

6 Claims, 3 Drawing Figures

TEXTILE YARN OR TAPE WINDING MACHINES

This invention relates to winders for textile yarn (either natural or synthetic), tape or thermoplastic filaments.

In winding a yarn package it is desirable to maintain a substantially constant surface speed of the package to obtain maximum production or quality.

Two basic methods of winding are presently used:

1. The package is wound either on a freely rotatable yarn or tape take-up spindle which is either driven by frictional contact between the package and a drive roller or the spindle is driven directly. The drive roller when used, may be tracked also to control the traverse of the yarn, or a separate constant speed traverse mechanism may be provided. This produces what is known as an "open-wound" package or
2. The package is wound on a positively driven winding (take-up) spindle with a constant ratio between the speed of rotation of the spindle and the linear movement of traverse means to lay the yarn or tape on the package. This produces what is known as a "precision-wound" package.

It is not practical to use a simple, inexpensive surface drive to produce precision wound packages since the torque required to drive both the spindle and traverse mechanism would require such a pressure between the package and the driven roller as possibly to damage the material being wound and adversely to affect the package formation. Additionally when winding conical shaped packages, wherein there is slip all along the face of the cone since the driving roller cannot drive all diameters at the same speed, the angle of cone that can be wound is limited.

The present invention is concerned with a winder on which the material to be wound is wound onto a positively driven take-up spindle. In order to produce a satisfactory package it is necessary that the speed of rotation of the take-up spindle be decreased as the package being wound increases in diameter so that the linear take-up speed of the yarn (which is the equivalent to the peripheral speed of the rotation of the package at any moment) remains substantially constant.

Various proposals to effect this desired object have been put forward but none hitherto has proved to be completely satisfactory. One of the difficulties is that the characteristics of any one yarn or tape being wound in one winding operation may well vary from those of the next yarn or tape to be wound on the same machine.

A method of maintaining the peripheral speed of a textile yarn package being wound on a positively driven take-up spindle at, or about, a predetermined speed, in accordance with this invention comprises sensing the peripheral speed of the package and comparing this speed with a predetermined set speed, variations between the actual and set speeds acting to vary the drive to the take-up spindle until the speed of the package is equivalent to the set speed.

A textile yarn or tape winding machine in accordance with this invention comprises a take-up spindle connected to a variable drive wherein means are provided to sense the surface speed of the package being wound and to compare the package speed with a predetermined set speed, the comparator means being connected to the variable speed drive in such a way that any variation in the yarn or package speed from the desired figure results in the spindle drive being adjusted until the yarn or package speed is again equivalent to the predetermined set speed.

The package speed sensing means conveniently comprises a roller positioned to engage the periphery of the package being wound on the spindle and the speed comparator means is preferably a mechanical unit in which case the roller may be connected to a screwed shaft, the screwed portion of the shaft carrying a threaded roller which is connected to means for rotating it at a constant predetermined speed. Movement of the threaded roller along the screwed shaft (in either direction) due to variations in the peripheral speed of the package from the set speed can then be employed to alter the drive for the spindle.

It will be appreciated that the actual speed of the package may not be equal to the set rotational speed of the threaded roller but the important factor is that the set speed of rotation of the roller around the screwed shaft is equal to the speed of rotation of the shaft when the peripheral speed of the package is at its predetermined figure. This can be arranged by an appropriate choice of drive to the threaded roller, of the diameter of the sensing roller and/or of other factors.

If a conical package is being wound, the peripheral speed of the portion of the package of larger diameter is greater than the portion of smaller diameter. There may, therefore, be some slippage between the speed sensing roller and the package and the roller will sense a mean package speed. This does not affect the utility of a winder in accordance with the invention since a limit on the maximum speed of rotation is determined by the set speed although as mentioned above the set speed if not necessarily equal to the actual maximum speed of rotation of the package.

The means for varying the drive to the take-up spindle which means is controlled by the movement of the threaded roller, may comprise any standard speed variation device, for example, a Kopp Variator, a Carter Hydraulic Drive, expanding pulleys or the like. One very convenient arrangement comprises a drum of magnetic material and a magnetic armature, the drum and armature being mounted for relative axial movement between a position in which the armature is located within the drum to a major extent and a position in which the armature extends out from the drum to a major extent. If then either the drum or armature is driven at a constant speed the other member is driven at a speed which corresponds to the relative axial position of the drum and armature. With such an arrangement the movement of the threaded roller can, through an appropriate linkage, mechanically alter the relative position of the drum and armature.

If a yarn breakage occurs the take-up spindle will be controlled to run only at the maximum speed determined by the set speed of the threaded roller (or other set speed device). However when a winder carrying a partially wound package is re-started after a stoppage the initial torque supplied to the take-up spindle will be the maximum as the speed control device will not operate until the package surface reaches its limiting speed. This maximum torque may cause momentary overspeeding of the spindle resulting in damage to the yarn or tape being wound. This may be avoided by the use of a non-return device, such as a pawl and ratchet or its equivalent such as a rod passing through a hole in a biased pivoted plate, in the connection between the speed comparator and the variable speed drive for the spindle such that the variable speed device is progressively prevented from increasing the torque and hence the speed beyond a safe limit as the yarn package diameter increases. The use of such a non-return device will normally require a mechanical freedom of movement on the drive connection to prevent damage when the linkage cannot move to the extent signalled by the speed comparator.

It may be desirable for a precision wound package winder to be convertible to an open-wound package winder. This may be achieved by a winder in accordance with a further feature of this invention which has a take-up spindle connected to a variable speed drive and a yarn traverse mechanism which may be connected either to the variable speed drive or to a constant speed drive. When the traverse mechanism is connected to the variable speed drive a precision wound package is produced but when it is connected to the constant speed drive an open wound package is produced.

An example of a textile yarn or tape winding machine in accordance with the invention will now be described by way of example with reference to the accompanying drawings in which.

Figure 1:
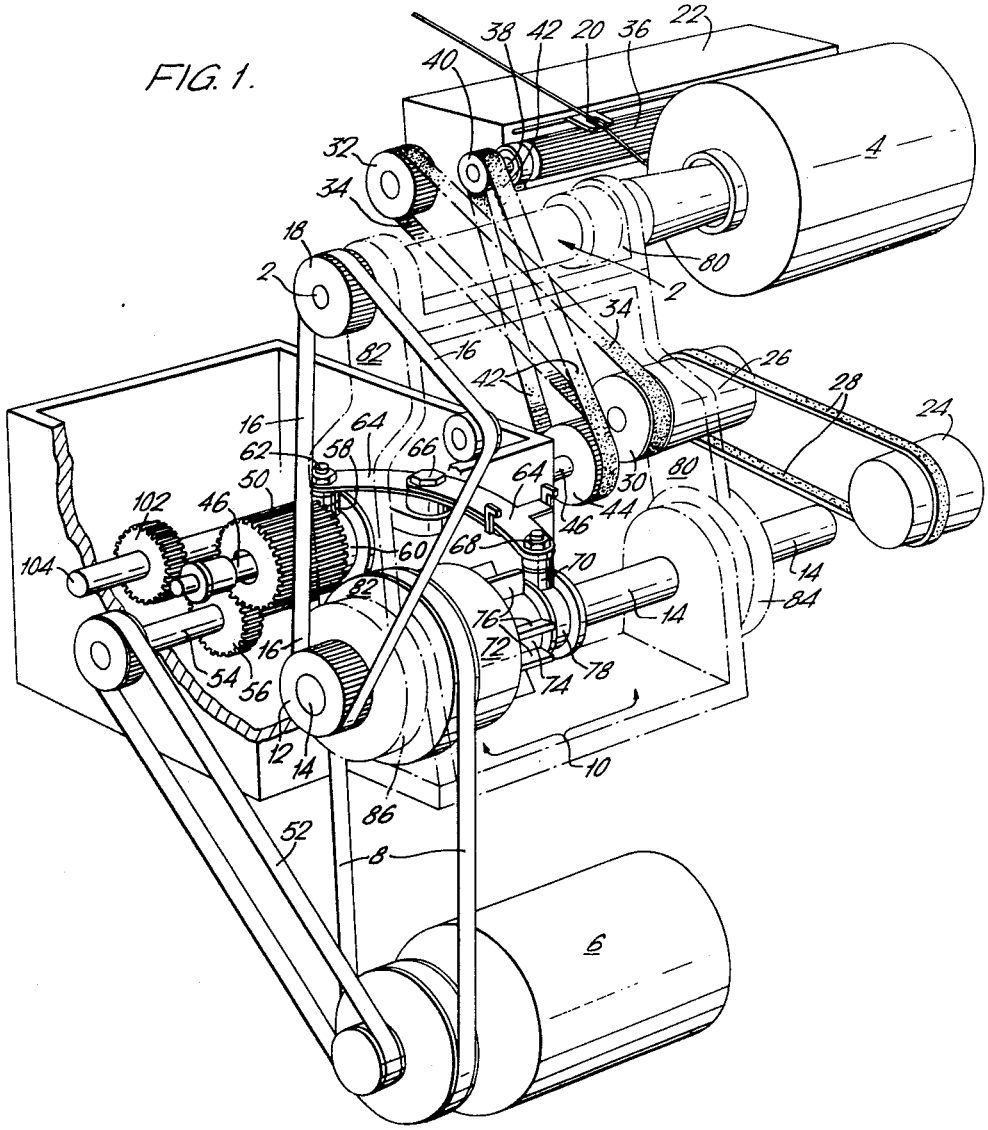
FIG. 1 is a perspective view of the winding machine.

Referring to FIG. 1 the winding machine comprises essentially a take-up spindle 2 on which a package 4 is wound the package being shown partially removed from the spindle.

The take-up spindle is driven by a drive motor 6 and a toothed belt 8 through a speed variation device generally indicated at 10, the output pulley 12 of which is mounted on an output shaft 14 and drives a second toothed belt 16 which in turn drives a toothed pulley 18 carried by the inner end of the take-up spindle 2.

A yarn guide eye 20 is driven to reciprocate along the length of the package by means of a drive (not shown) housed within a traverse box 22, the drive of which is maintained in relationship to the drive of the spindle since it is taken from the drive shaft 14 through pulley 24 (which is driven by the shaft 14) and 26, the pulleys being connected by a belt 28. The pulley 26 is connected to a toothed pulley 30 which drives a corresponding toothed pulley 32 by means of a toothed belt 34. The pulley 32 directly drives the traverse mechanism within the traverse box 20.

It will be appreciated that as the diameter of the package 4 being formed on the take-up spindle 2 increases, the peripheral speed of the package also tends to increase with potential undesirable effects on the yarn being wound.

To avoid this the peripheral speed of the package is sensed by a roller 36 which engages the periphery of the package immediately adjacent the position at which the yarn engages the package the roller is serated over at least a portion of its length, preferably the portion intended to engage the portion of a conically shaped package having the largest diameter.

The roller 36 is carried on a shaft 38 on which is mounted a pulley 40 driving through a toothed belt 42, a toothed pulley 44 secured to a shaft 46 having at least its other end portion formed with a screw thread. This screw thread engages and is located within a threaded gear wheel 50 which is driven at a constant speed by the main drive motor 6 through a toothed belt 52 which drives, through a shaft 54, a gear wheel 56 which meshes with threaded gear 50.

It will be appreciated that if the speed of rotation of the roller 36 is equivalent to the speed of rotation of the gear 50 the position of the gear wheel 50 along the length of the screwed section of the shaft 46 will not alter. If however the rotational speed of the roller 36 is greater, or less, than that of the gear 50 then the gear 50 will physically move one way or the other along the screw. Such movement is used to adjust the drive variator 10 so that the drive for the take-up spindle is altered until the rotational speeds of the roller 36 and gear 50 again match.

This is achieved as shown in FIG. 1 by linkage which mechanically connects the gear 50 and speed variator 10 comprising a small roller 58 which is located in a groove 60 of the gear 50 and the stud 62 of which is carried at one end of a link 64 pivoted at 66 between its ends. The other end of the link carries the stud 68 of a roller 70 which engages the speed variator 10.

The variator 10 comprises a driven drum 72 of magnetic material which is driven by the drive belt 8 and an armature 74 having a series of magnets 76. The armature 74 is splined to the drive shaft 14 but is free to move axially therealong in accordance with the position of the roller 68 which engages in a groove 78 in a drum connected to the armature. When the armature 74 is moved to a position relatively far within the confines of the drum 72 the magnetic force between the armatue 74 and the drum 72 is high and hence the drive transmitted between the drum 72 and the armature 74 (and hence the drive shaft 14) is relatively high so that the speed of rotation of the take-up spindle 2 is high. As the armature 74 is moved relatively out from the drum 72, the torque which can be transmitted from the drum to the armature decreases and hence the spindle is driven at a relatively lower speed.

In use, as the diameter of the package 4 increases the spindle 2, which is carried in bearings on brackets 80 and 82, which are themselves pivotally mounted about bearings 84 and 86 on the drive spindle 14, moves away from the traverse box 22 but the periphery of the package remains in contact with the roller 36. As the peripheral speed of the package tends to increase throughout the winding of the package, the threaded gear 50 is gradually moved along the screwed shaft 48 and the drive to the take-up spindle 2 is gradually diminished so that the peripheral speed of the package 4 and hence the linear take-up speed of the yarn being wound, is maintained substantially constant or at least constant once it reaches a predetermined maximum.

It will be appreciated that the motor 6 could be replaced by a drive shaft which in turn may drive a number of take-up spindles as well as a corresponding number of threaded gear wheels 50.

Figure 2:
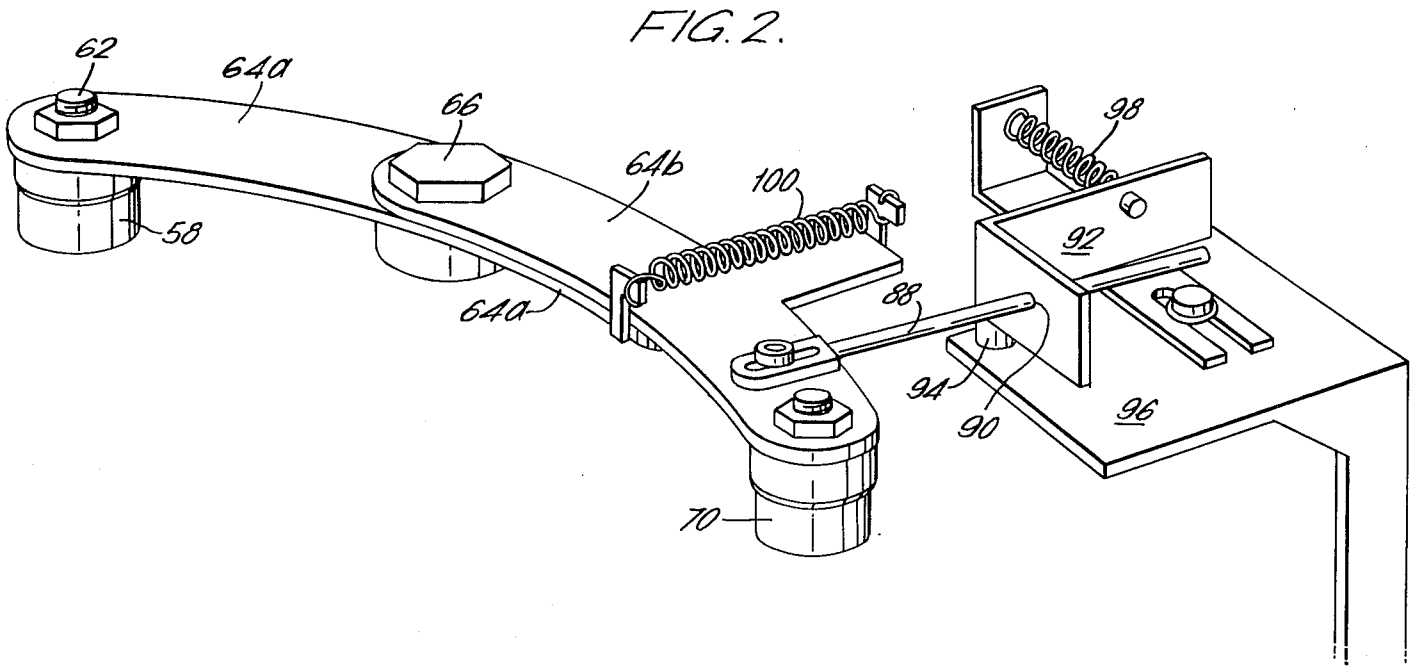
FIG. 2 is a detail view of a modified linkage employed to vary the drive to the spindle.

It is thought that a problem may arise if the winder has to be stopped after a package has been only partially wound. When winding recommences the magnetic armature 74 will be positioned wholly within the drum 72 (because the surface speed of the package is zero) and maximum torque will be applied to the drive from the take-up spindle. This maximum torque may cause a momentary over-speeding of the package with consequent burning or glazing of the yarn being wound if this is of an artificial plastics material. This problem is solved by the modification illustrated in FIG. 2 in which the lever 64 is formed in two parts (64*a* and 64*b*) which are pivoted about the pivot 66. Pivotably attached to lever 64b is a rod 88 which passes through a hole 90 in one side of a L-shaped plate 92. The plate 92 is pivotally attached at 94 to a support plate 96 as biased by a spring 98 so that the rod 88 can move freely further into its hole 90 in the bracket 92 (to the right as seen in the drawing) but not out therefrom as the plate is pivoted by spring 98 to jam the rod. The two halves of the lever are biased together so as to form an operative curved lever by a spring 100.

During the start of a winding operation whenever the surface speed of the package is less than the predetermined set speed, the gear 50 will move along the screw so as to cause the lever 64 to pivot as one piece about its centre 66 to push the magnetic armature to its most inward position relative to the drum, i.e. the position of maximum torque. In other words, the lever 64 is not in any way held by the rod 88 and thus can move as one piece during the initial starting up of a package.

If a yarn break occurs and the machine is stopped, to piece the end, on re-starting during the initial acceleration the gear 50 will be moved along the screw so as to drive the armature right into its associated drum. However, due to the relatively large diameter of the package at this stage there would then be a certain amount of over-run before the armature retracted again and the surface speed of the package could be too high and thus damage the yarn.

This is prevented by the rod 88 which progressively moves further through its hole 90 in the bracket 92 as the package diameter increases. When the winder is stopped and restarted during winding the portion 64b carrying the roller 70 which moves the armature is prevented from pivoting in the direction to increase the torque transmitted due to the rod 88 not being able to move out from its hole 90. The lever 64 "breaks" the portion 64a moving relatively to the portion 64b about the pivot 66 in accordance with the position of the threaded gear 50, against the bias of spring 100. The lever remains in this position until the predetermined speed has been reached when the gear 50 again moves back along the screw 48 until the two halves of the lever 64 are again "closed" in the position shown in FIG. 2.

Figure 3:
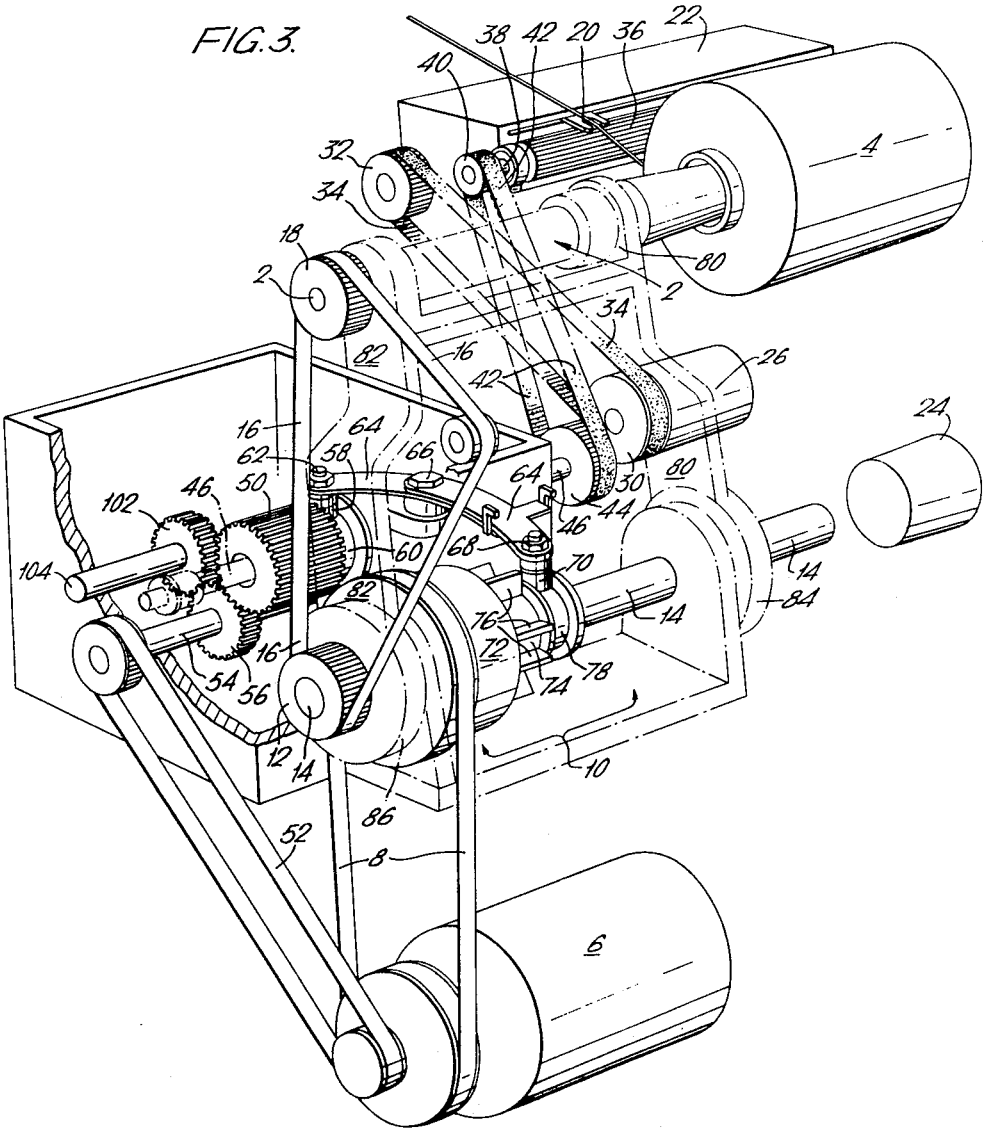
FIG. 3 is a view corresponding to FIG. 1 but showing the winder converted to wind open-wound packages.

FIG. 3 shows the winder of FIG. 1 converted to produce open wound packages.

This is done by removing the belt 28, forming part of the drive from the variable speed device to the traverse mechanism, from its pulleys 24 and 26 and at the same time connecting the traverse box to the constant speed drive by axially moving a gear 102 which is splined to a shaft 104, into mesh with the constant speed drive gear 56. The shaft 104 carries the traverse mechanism drive pulley 30. As a result the guide eye 20 is reciprocated at a constant speed irrespective of the speed of the take-up spindle.

When the winder is producing an open-wind package, there is a danger that ribboning will occur i.e. the tendency for the yarn to be wound in the package in a set pattern causing a build up of yarn over parts of the package with gaps between the built-up parts. This effect may be overcome with the use of any known standard anti-ribboning device.

It will be appreciated that the various drives may be adjusted by varying the size of the various drive pulleys so that a desired "set" maximum take-up speed may be produced for any yarn or tape.

I claim:

1. A textile yarn or tape winding machine comprising a take-up spindle which is connected to a variable drive including:

(a) means to sense the surface or peripheral speed of a yarn or tape package being wound;

(b) means to compare the package surface or peripheral speed with a predetermined set speed;

(c) means to vary the drive to the spindle in response to overspeed or underspeed of the actual surface or peripheral speed of the package as compared to the set speed; and (d) means connected to the drive for the spindle for laying the yarn on the package so as to produce a precision wound package.

2. A textile yarn or tape winding machine as claimed in claim 1 in which:

said means to compare comprises a shaft with a screw thread over at least a portion of its length and a threaded member engaged on the screwed portion of the shaft, said variable drive including a drum of magnetic material and an armature, the drum and armature mounted for relative axial movement between a position in which the armature is located within the drum to a major extent and a position in which the armature extends out from the drum to a major extent, a constant speed drive means connected to one of said shaft or threaded member and the other connected to said means to sense, linking means including a pivoted lever coupled between said means for comparing and, said variable drive to produce relative axial movement between said magnetic drum and armature in response to relative movement between said shaft and said threaded member, a non-return device and a fixed bracket, with said linking means coupled to said fixed bracket through said non-return device, whereby relative movement between said shaft and threaded member is produced in response to package surface speed different from said set speed which relative movement is coupled via said linking means to produce relative axial movement between said magnetic drum and armature to vary the drive to said spindle in a correcting sense and said non-return device limits spindle speed beyond safe speeds on restarting after stoppage during winding a package.

3. The apparatus of claim 2 in which said lever comprises a pair of links pivotally connected and biased to a normal operative position so that the links are not damaged if said lever as a whole is prevented from moving to the extent required by relative movement between said shaft and threaded member.

4. A textile yarn or tape winding machine comprising a take-up spindle which is connected to a variable drive including:

(a) means to sense the surface or peripheral speed of a yarn or tape package being wound;

(b) means to compare the package surface or peripheral speed with a predetermined set speed;

(c) means to vary the drive to the spindle in response to overspeed or underspeed of the actual surface or peripheral speed of the package as compared to the set speed;

(d) constant speed drive means, and (e) means connected to said constant speed drive means for laying the yarn or tape on the package so as to produce an "open wound" package.

5. A textile yarn or tape winding machine as claimed in claim 4 in which:

said means to compare comprises a shaft with a screw thread over at least a portion of its length and a threaded member engaged on the screwed portion of the shaft, said variable drive including a drum of magnetic material and an armature, the drum and armature mounted for relative axial movement between a position in which the armature is located within the drum to a major extent and a position in which the armature extends out from the drum to a major extent, said constant speed drive means connected to one of said shaft or threaded member and the other connected to said means to sense, linking means including a pivoted lever coupled between said means for comparing and, said variable drive to produce relative axial movement between said magnetic drum and armature in response to relative movement between said shaft and said threaded member, a non-return device and a fixed bracket, with said linking means coupled to said fixed bracket through said non-return device, whereby relative movement between said shaft and threaded member is produced in response to package surface speed different from said set speed which relative movement is coupled via said linking means to produce relative axial movement between said magnetic drum and armature to vary the drive to said spindle in a correcting sense and said non-return device limits spindle speed beyond safe speeds on restarting after stoppage during winding a package.

6. The apparatus of claim 5 in which said lever comprises a pair of links pivotally connected and biased to a normal operative position so that the links are not damaged if said lever as a whole is prevented from moving to the extent required by relative movement between said shaft and threaded member.

* * * * *